United States Patent [19]

Connolly, Jr.

[11] 4,446,544

[45] May 1, 1984

[54] SMALL DIAMETER, LOW FREQUENCY MULTIMODE HYDROPHONE

[75] Inventor: George C. Connolly, Jr., East Lyme, Conn.

[73] Assignee: The United States of America as represented by the Secretary of the Navy, Washington, D.C.

[21] Appl. No.: 326,303

[22] Filed: Nov. 30, 1981

[51] Int. Cl.[3] ..... H04R 17/00

[52] U.S. Cl. ..... 367/155; 310/337; 367/159; 367/162

[58] Field of Search ..... 367/153, 155, 157, 159, 367/162, 164, 176, 165, 173; 310/326, 337, 369

[56] References Cited

U.S. PATENT DOCUMENTS

| | | | |
|---|---|---|---|
| 3,043,967 | 7/1962 | Clearwaters | 367/153 X |
| 3,139,603 | 12/1964 | Church et al. | 340/10 |
| 3,142,035 | 7/1964 | Harris | 310/337 X |
| 3,177,382 | 1/1965 | Green | 310/8.7 |
| 3,230,505 | 1/1966 | Parker et al. | 310/369 |
| 3,290,646 | 12/1966 | Ehrlich et al. | 367/173 |
| 3,543,059 | 10/1968 | Angeloff | 310/8.7 |
| 3,559,162 | 1/1971 | Granfors et al. | 367/159 |
| 3,624,429 | 11/1971 | Behrendt | 367/155 X |
| 3,845,333 | 10/1974 | Holloway | 367/159 X |
| 3,982,144 | 9/1976 | Rogers et al. | 367/159 X |
| 3,992,693 | 11/1976 | Martin et al. | 367/155 |

*Primary Examiner*—Harold J. Tudor

*Attorney, Agent, or Firm*—Robert F. Beers; Arthur A. McGill; Michael J. McGowan

[57] ABSTRACT

A multimode hydrophone of small diameter and low weight providing dipole directivity patterns over a decade range of low frequencies by utilizing a pair of orthogonal dipole signals and a nondirectional reference signal to eliminate directional ambiguity. Each multimode hydrophone is a thin wall tube divided electrically into quadrants which permits differencing or opposing halves to produce signals with dipole directivity patterns and the formation of a nondirectional reference signal by summing all four quadrants. The hydrophone tube comprises inert and piezoelectric materials, selected and combined so as to shift the resonant frequency of the tube lower while keeping the over-all tube diameter as small as possible.

8 Claims, 4 Drawing Figures

SMALL DIAMETER, LOW FREQUENCY MULTIMODE HYDROPHONE

STATEMENT OF GOVERNMENT INTEREST

The invention described herein may be manufactured and used by or for the goverment of the United States of America for governmental purposes without the payment of any royalties thereon or therefor.

BACKGROUND OF THE INVENTION (1) Field of the Invention

The present invention relates to multimode hydrophones for receiving acoustic signals and more specifically to a small diameter, low frequency multimode hydrophone which provides direction finding capabilities for locating an acoustic source over a decade band of low frequencies.

(2) Description of the Prior Art

Presently, at frequencies below 1.0 kHz, pressure gradient hydrophones, generally with dimensions less than one-sixth of a wavelength at the highest frequency of interest, are used as sensors for direction finding systems. At frequencies above 1.0 kHz, multimode hydrophones are used which are thin wall tubes divided electrically into quadrants to permit the differencing of opposing halves to produce signals with dipole directivity patterns and the formation of a nondirectional reference signal by summing all four quandrants. Such hydrophones use a plurality of modes of vibration, specifically the first circumferential mode from which two orthogonal dipole patterns can be derived for direction finding and also the radial mode which serves as a reference signal to permit removal of directional ambiguities or which, when added to or subtracted from the dipole signals, using proper gain and phase compensation, will yield a cardoid directivity pattern.

Multimode hydrophones can operate satisfactorily over a decade of frequency with the range of frequencies determined by hydrophone diameter. The performance of conventional piezoelectric and magnetostrictive multimode units is satisfactory when the hydrophone diameter is greater than one-tenth of a wavelength but less than one wavelength. In order to shift the usable operating range of frequencies lower, it is necessary to increase the diameter of the tube, e.g., at 1.0 kHz, the tube diameter would have to be at least 5.0 inches or larger to provide satisfactory dipole directivity patterns. For many hydrophone applications such a large diameter is unacceptable in that thin wall tubes of large diameter are not manufacturable as a single piece of ceramic; also, for applications such as dome mounting or towed array use, minimizing flow induced noise by using small diameters is crucial to satisfactory operation especially as pertains to low frequency directional applications.

What is thus required is a small diameter multimode hydrophone which operates over a decade range of low frequencies.

SUMMARY OF THE INVENTION

The present invention teaches a multimode hydrophone of small diameter and low weight providing improved dipole directivity patterns over a decade range of low frequencies by utilizing a pair of orthogonal dipole signals and nondirectional reference signal to eliminate directional ambiguity. Each multimode hydrophone is a thin wall tube divided electrically into quadrants to permit differencing of opposing halves to produce signals with dipole directivity patterns and the formation of a nondirectional reference signal by summing all four quadrants. The hydrophone tube comprises inert and piezoelectric materials, selected and combined so as to shift the resonant frequency of the tube lower while keeping the overall tube diameter as small as possible. Piezoelectric surfaces within each quadrant have wires soldered to internal and external surfaces of each segment, thus providing two leads from each quadrant, one internal and one external. The electrical connections thus provided operate to output the average of the electrical signals generated over each quadrant.

The primary object of subject invention is to provide a low frequency, multimode hydrophone of small diameter.

Another object of the present invention is that it be light in weight.

Still another object of the present invention is to provide a small diameter multimode hydrophone which operates over a decade range of low frequencies.

A still further object of subject invention is to provide a small diameter multimode hydrophone with improved dipole patterns at low frequency.

These and other objects and advantages of the present invention will become more apparent from the following detailed description when considered in conjunction with the accompanying drawings.

DESCRIPTION OF THE PREFERRED EMBODIMENT

The present invention provides a small diameter, multimode hydrophone which operates over a decade range of low frequencies. This type of hydrophone is a thin wall tube, constructed from a combination of inert and piezoelectric materials, the piezoelectric portions of which are wired electrically so as to form quadrants. In a thin-walled tube the resonant frequency, f, of the radial (breathing) mode of vibration can be expressed as: $f=C/2\pi r$ where C is the speed of sound transmission in the tube material and r is the tube radius. Thus for a chosen radius, the only way to shift the resonant frequency and hence the useful frequency range of a hydrophone lower is to reduce the effective transmission speed of sound in the materials the tube is made of. Because there is insufficient variation in the speed of sound in various available piezoelectric materials to produce the required resonance shift just by changing to another piezoelectric material, it is necessary to make a more radical change in the tube design. The instant invention uses inert materials, such as Fiberglas and/or epoxy, having significantly lower sound transmission speed, to shift the resonant frequency of the tube lower.

In this way small diameter, i.e., 1" to 3", multimode hydrophones may be built with thin walls, i.e., ⅛" to ¼" thick, resulting concurrently in lightweight units with reduced flow noise profiles.

Figure 1:
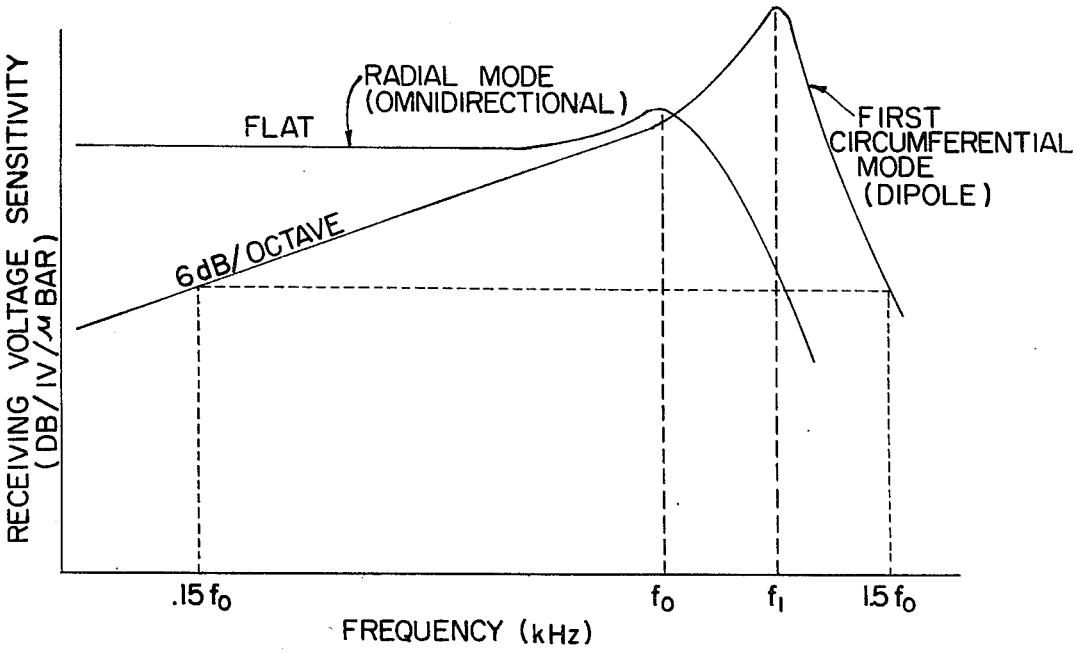
FIG. 1 shows a graphical representation of receiving sensitivities of the omnidirectional and dipole modes of a multimode hydrophone.

Referring now to FIG. 1 there is shown a graph plotting multimode hydrophone receiving voltage sensitivity vs. frequency for both the radial (omnidirectional) and the first circumferential (dipole) modes of vibration. The resonant frequency of the radial mode is identified as $f_o$ while the resonant frequency of the first circumferential mode is identified as $f_1$. As can be seen in FIG. 1 the reason for multimode hydrophones being limited to the decade range of frequency as determined by the diameter of the tube is that the receiving voltage sensitivity of the dipole signals fall to a normally unusable level below approximately 0.15 $f_o$ while above approximately 1.5 $f_o$ the receiving voltage sensitivity of both the omnidirectional and the dipole signals fall to unusable low levels. The preferred embodiment herein describes a multimode hydrophone suitable for satisfactory operation at frequencies between 0.1 and 10 kHz in the low frequency acoustic range. This entire range may now be monitored by just two hydrophones, one of which covers the decade range of frequencies between 0.1 kHz and 1 kHz while the other covers the decade range of frequencies between 1 kHz and 10 kHz.

Figure 2:
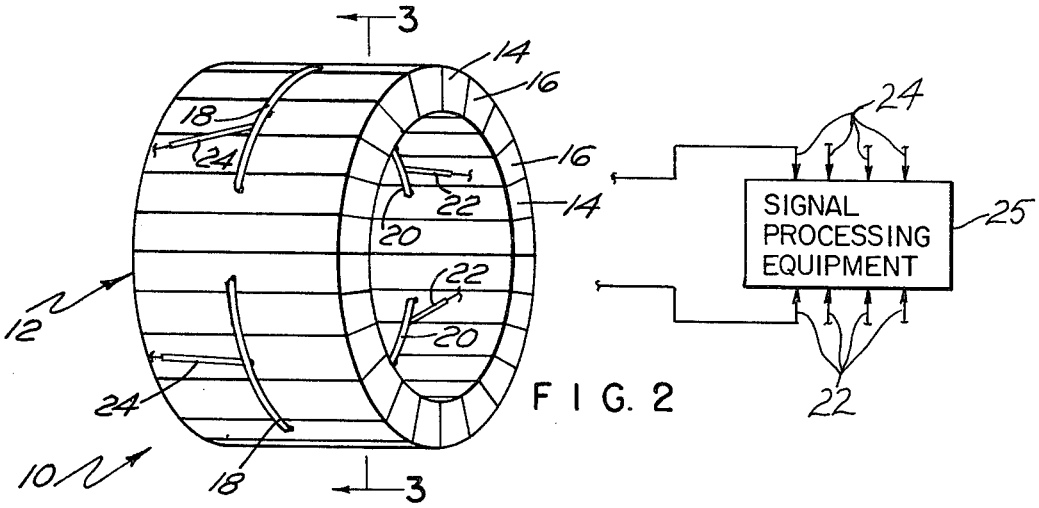
FIG. 2 shows a perspective view of one embodiment of a hydrophone built according to the teachings of subject invention.

FIG. 2 shows a multimode hydrophone 10 built according to the teachings of subject invention. Multimode hydrophone 10 comprises generally cylindrical tube 12 which is fabricated from a plurality of cylindrical segments arranged so as to alternate inert cylindrical segments 14 and radially polarized piezoelectric cylindrical segments 16 to form tube 12. The piezoelectric segments 12 in each quadrant are connected by an external connecting wire 18, and an internal connecting wire 20, thereby averaging the electrical signals produced in that quadrant. Lead wires 22 and 24 are attached to internal connecting wire 20 and external connecting wire 18 in each quadrant, respectively. The four sets of lead wires are then connected to signal processing equipment 25 which produces an omnidirectional signal and two spatially orthogonal directional signals containing frequency and bearing information.

Figure 3:
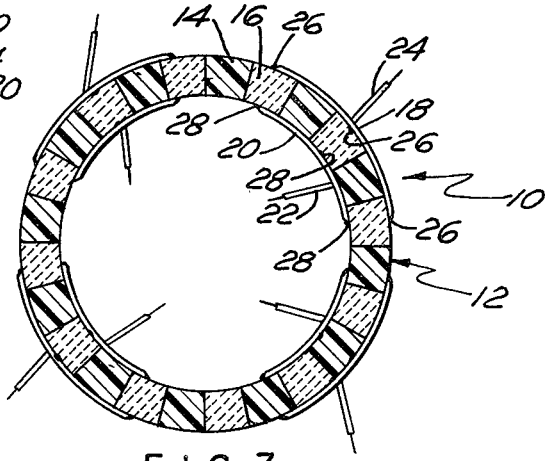
FIG. 3 shows a cross-sectional view of the hydrophone of FIG. 2 taken along line 3—3 thereof.

FIG. 3 shows a cross-sectional view of the hydrophone of FIG. 2. The alternating arrangement of inert cylindrical segments 14 and radially polarized piezoelectric cylindrical segments 16 are clearly depicted as is the electrical connections within a quadrant. Inert cylindrical segments 14 are selected to have a speed of sound transmission such as that of Fiberglas or epoxy. Segments are bonded together with an commercially available bonding material. External connecting wire 18 is electrically attached to each of the plurality of piezoelectric segments 16 within the upper right hand (first) quadrant by external solder joints 26. Internal connecting wire 20 is electrically attached to the plurality of piezoelectric segments 16 within the quadrant by internal solder joints 28. The total voltage output from the first quadrant thus appears across leads 22 and 24 of that quadrant. The remaining three quadrants are arranged and connected in the same fashion as the first resulting in four voltage outputs from the hydrophone, i.e., one set of leads from each quadrant.

Figure 4:
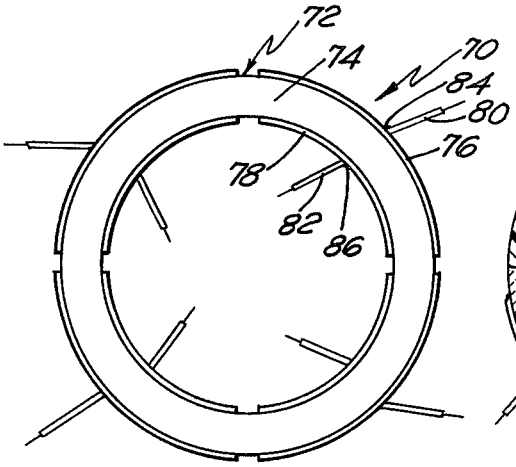
FIG. 4 shows an end view of another embodiment of a hydrophone built according to the teachings of subject invention.

Referring now to FIG. 4 there is shown a second embodiment of subject invention. Multimode hydrophone 70 comprises generally cylindrical tube 72 which is an assembly of continuous, thin wall, inert tube 74, a plurality of radially polarized piezoelectric polymer film quadrantal segments 76 and 78, and connecting lead wires 80 and 82. As before, construction of the upper right hand (first) quadrant is described but it is understood that the remaining three quadrants are similarly constructed. Inert tube 74 is selected to have a relatively low speed of sound transmission such as that of Fiberglas or epoxy. An external piezoelectric polymer film quadrantal segment 76 is bonded to the outside inert tube diameter surface of the first quadrant using commercially available bonding materials. Similarly, an internal piezoelectric polymer film quadrantal segment 78 is bonded to the internal inert tube diameter surface of the first quadrant. Each quadrantal segment covers slightly less area than the area presented by the inert tube quadrant. Lead wires 80 and 82 are attached to polymer coatings 76 and 78, respectively by solder joints 84 and 86, respectively. Voltage outputs from the first quadrant are measured between leads 80 and 82. Voltage outputs from the other three quadrants, together with the output from the above described first quadrant represent the four voltage outputs of hydrophone 70 which are then transmitted to signal processing equipment as described supra.

What has thus been described is a small diameter, low frequency multimode hydrophone of low weight, providing dipole directivity patterns over a decade range of low frequencies by utilizing a pair of orthogonal dipole signals and a nondirectional reference signal to eliminate directional ambiguity. Each multimode hydrophone is a thin wall tube divided electrically into quadrants which permits differencing of opposing halves to produce signals with dipole directivity patterns and the formation of a nondirectional reference signal by summing all four quadrants. The hydrophone tube comprises inert and piezoelectric materials, selected and combined so as to shift the resonant frequency and corresponding decade range of the tube lower while keeping the overall tube diameter as small as possible.

Obviously, many modifications and variations of the present invention are possible in light of the above teachings. For example, a spherical multimode hydrophone may be built using the same technique. Also, the teachings of the present invention make possible construction of a multimode hydrophone which operates in air. Additionally, while in the preferred embodiment the piezoelectric material used as radially polarized, tangential polarization can be used and may be preferred in some instances.

I claim:

1. A small diameter, low frequency, multimode hydrophone for receiving relatively low frequency, plane-wave acoustic signals impinging thereon, comprising:

piezoelectric means, for converting each said relatively low frequency, plane-wave acoustic signal to a plurality of quadrantal electrical signals, each of said electrical signals being proportional to said plane-wave acoustic signal as received by separate quadrants of said hydrophone, said piezoelectric means further comprising a plurality of piezoelectric cylindrical segments;

inert means, bonded to said piezoelectric means, for reducing the propagation speed of sound within said multimode hydrophone thereby permitting said small diameter hydrophone to be formed, said inert means being bonded to said piezoelectric means, said inert means further comprising a corresponding plurality of inert cylindrical segments of identical size and shape as said piezoelectric cylindrical segments, interspersed alternately between said plurality of piezoelectric cylindrical segments, each said inert cylindrical segment being bonded to adjacent piezoelectric cylindrical segments thereby forming a generally cylindrical thin wall tube of relatively small diameter having at least two piezoelectric cylindrical segments per quadrant;

electrical conductor means, connected to said piezoelectric means within each quadrant of said hydrophone, for producing and transmitting said quadrantal electrical signals; and signal processing means, attached to said conductor means, for receiving said quadrantal electrical signals and producing an omnidirectional signal and two spatially orthogonal directional signals containing a decade range of frequency and bearing information therefrom.

2. A small diameter, low frequency, multimode hydrophone according to claim 1 wherein said at least two piezoelectric cylindrical segments within each quadrant of said generally cylindrical thin walled tube are electrically connected to said electrical conductor means in order to average the electrical signals generated over said quadrant.

3. A small diameter, low frequency multimode hydrophone according to claim 2 wherein said plurality of piezoelectric cylindrical segments are formed from a piezoelectric ceramic material.

4. A small diameter, low frequency, multimode hydrophone according to claim 3 wherein said plurality of inert cylindrical segments are formed from an epoxy material having a preselected low sound propagation velocity characteristic.

5. A small diameter, low frequency, multimode hydrophone according to claim 3 wherein said plurality of inert cylindrical segments are formed from Fiberglas material having a preselected low sound propagation velocity characteristic.

6. A small diameter, low frequency, multimode hydrophone according to claims 4 or 5 wherein said piezoelectric ceramic material is radially polarized.

7. A small diameter, low frequency, multimode hydrophone according to claims 4 or 5 wherein said piezoelectric ceramic material is tangentially polarized.

8. A small diameter, low frequency, multimode hydrophone according to claim 6 wherein said electrical conductor means further comprises:

a plurality of external quadrantal conductors, each said conductor connecting the at least two piezolectric segments of the respective quadrant together, for providing a plurality of external quadrantal output leads; and a corresponding plurality of internal quadrantal conductors, each said conductor connecting the at least two piezoelectric segments of the respective quadrant together, for providing a plurality of internal quadrantal output leads.

* * * * *